US006533486B1

(12) United States Patent
To

(10) Patent No.: US 6,533,486 B1
(45) **Date of Patent: *Mar. 18, 2003**

(54) RING BINDER HAVING ACTUATING LEVER WITH CUSHION MEMBER

(75) Inventor: Chun Yuen To, Kauto Shan Shatin N.T. (HK)

(73) Assignee: World Wide Stationary Mfg. Co., Ltd., Kwai Chung (HK)

( * ) Notice: Subject to any disclaimer, the term of this patent is extended or adjusted under 35 U.S.C. 154(b) by 92 days.

This patent is subject to a terminal disclaimer.

(21) Appl. No.: 09/665,948

(22) Filed: Sep. 21, 2000

Related U.S. Application Data

(63) Continuation-in-part of application No. 09/539,712, filed on Mar. 31, 2000.

(51) Int. Cl.[7] ..... B42F 13/20

(52) U.S. Cl. ..... 402/38; 402/36; 402/41; 402/39; 402/31

(58) Field of Search ..... 402/26, 31, 36, 402/37, 38, 39, 40, 41, 42, 70, 73; D19/26, 27, 32

(56) References Cited

U.S. PATENT DOCUMENTS 5,234,276 A 8/1993 Semerjian et al.
5,354,142 A 10/1994 Yu
5,836,709 A * 11/1998 Cheung ..... 402/41
6,280,114 B1 * 8/2001 To ..... 402/41
6,364,558 B1 * 4/2002 To ..... 402/36

* cited by examiner

*Primary Examiner*—Willmon Fridie, Jr.
(74) *Attorney, Agent, or Firm*—Birch, Stewart, Kolasch & Birch, LLP

(57) ABSTRACT

A ring binder includes a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes a tab with a cushion member thereon. The actuating lever includes a toothed groove therein for engaging and retaining a tongue of the cushion member on the actuating lever. The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

20 Claims, 4 Drawing Sheets

RING BINDER HAVING ACTUATING LEVER WITH CUSHION MEMBER

This application is a Continuation-in-Part of application Ser. No. 09/539,712, filed Mar. 31, 2000, the entire contents of which are hereby incorporated by reference.

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half-rings are attached to each of the hinged leaves so that pivoting of the hinged leaves will open or close the half-rings in a snapping motion. This motion is caused by movement of actuating levers located at each end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which it typically nickel plated, the actuating levers can become slippery, causing the user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the fingers of the binder operator and/or to make the actuating levers longer so that more leverage is available. The cover is formed of two hinged plastic pieces that are snapped together to completely encase the actuating lever. Unfortunately, the plastic cover is susceptible to breakage, especially the tiny interlocking studs which hold the two halves together. The hinge can provide sharp edges, especially at the corners, and the seam between the mating halves can collect dirt and dust. Also, the hinge is susceptible to breakage. In addition, the cover is rigid, and rather large and cumbersome, approximately three times the size of the actuating lever, resulting in an unpleasant appearance.

There is a need in the art for a ring binder having actuating levers which are comfortable to use and slip resistant, and which minimize the feedback of undesirable shock forces produced by the snap action of the rings when opening and closing the rings.

SUMMARY OF THE INVENTION

The present invention fulfills the aforementioned need in the art by providing a ring binder including a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes a tab with a cushion member thereon. The actuating lever includes a toothed groove therein for engaging and retaining a tongue of the cushion member on the actuating lever.

The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not imitative of the present invention, and wherein.

DETAILED DESCRIPTION OF THE PREFERRED EMBODIMENT

Figure 1:
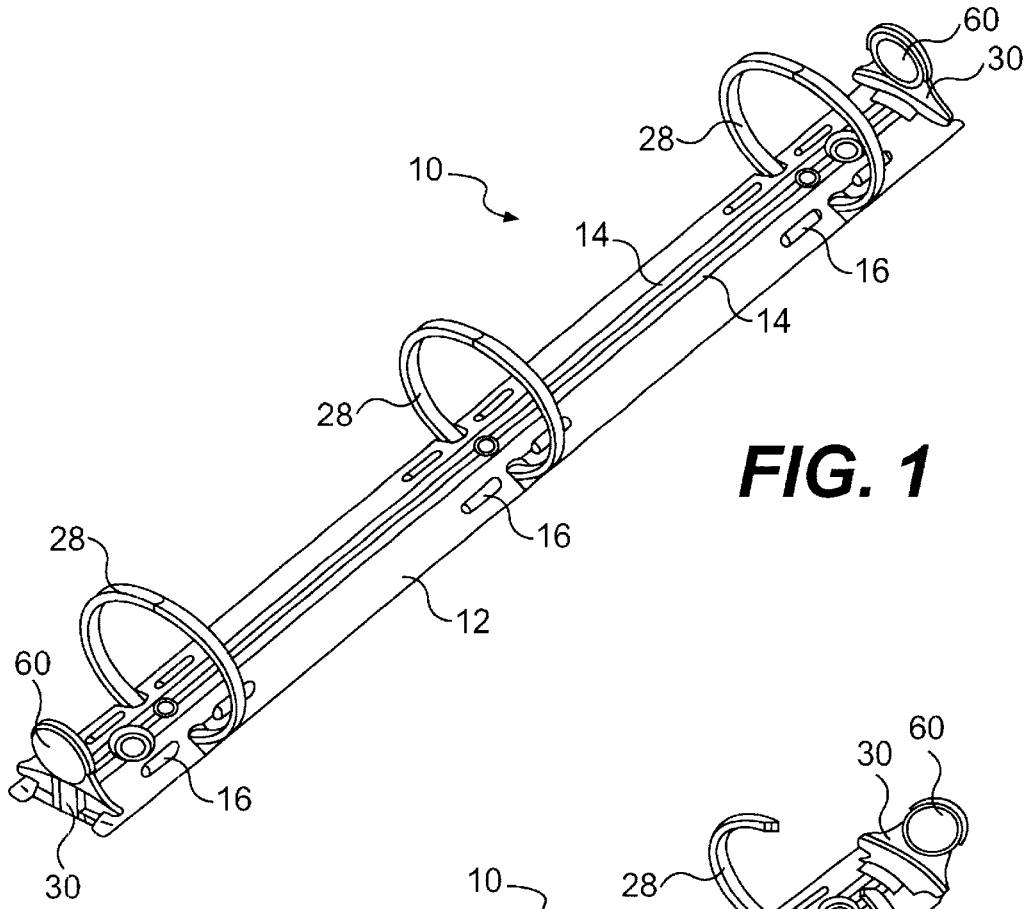
FIG. 1 is a perspective view showing the upper side of the ring binder of the present invention with the rings in a closed position.
Figure 2:
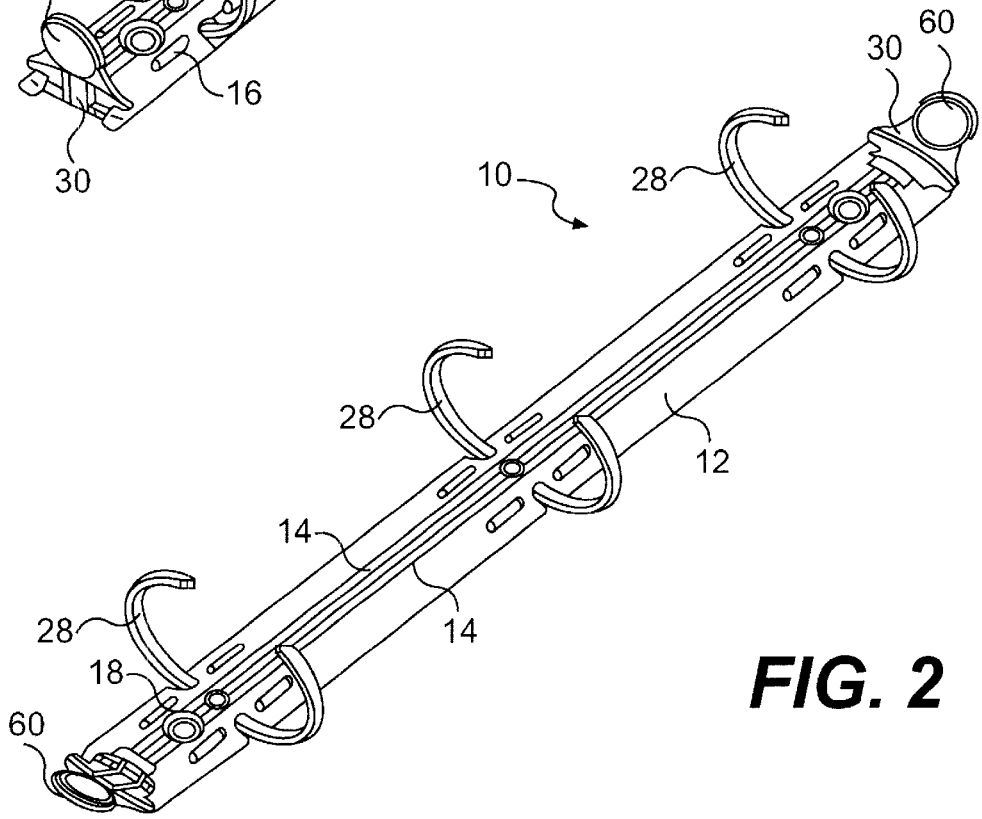
FIG. 2 is a perspective view showing the upper side of the ring binder of the present invention with the rings in an open position.
Figure 3:
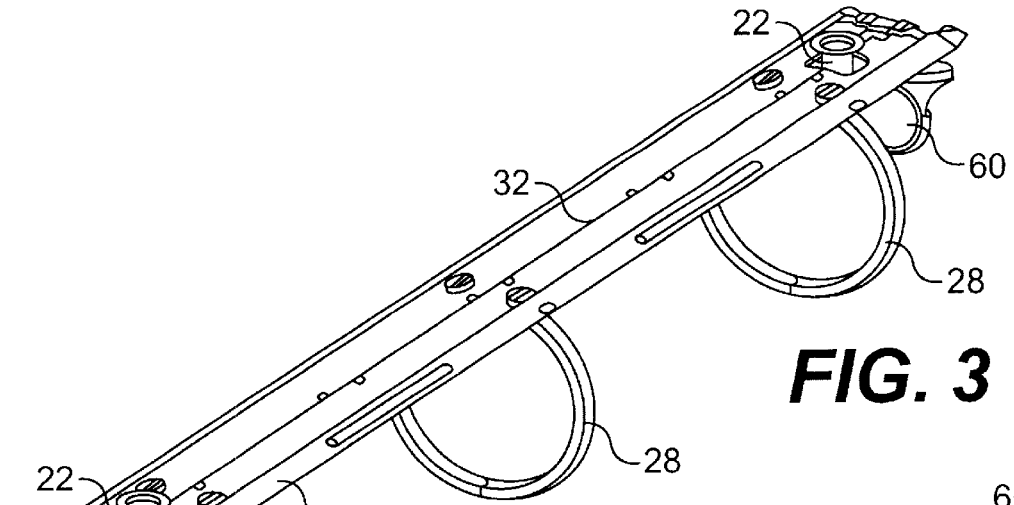
FIG. 3 is a perspective view showing the underside of the ring binder.
Figure 4:
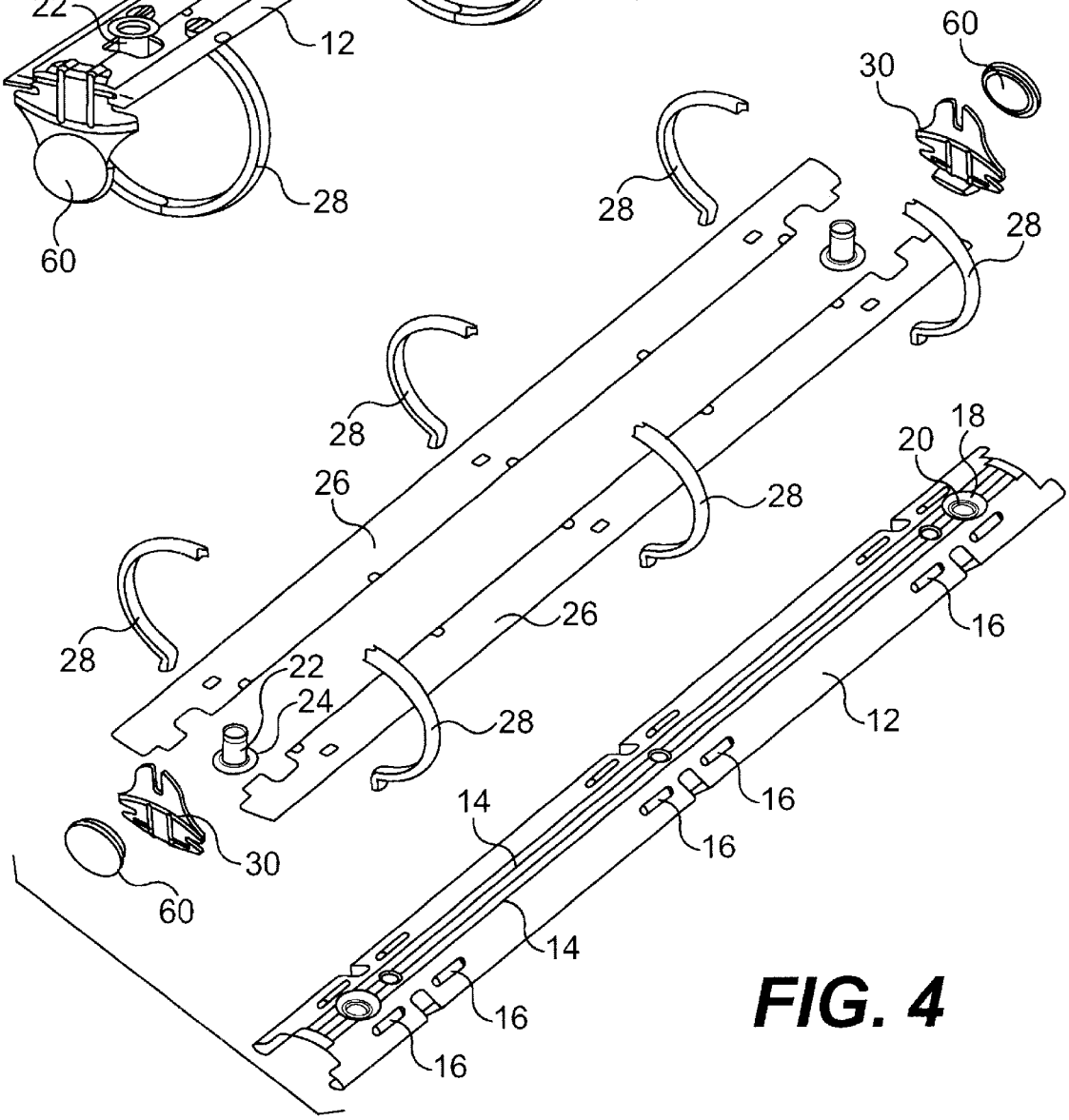
FIG. 4 is an exploded perspective view of the ring binder.

Referring in detail to the drawings, and with particular reference to FIGS. 1–4, a ring binder of the present invention is shown. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, for example, by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the center thereof which protrude upwardly and outwardly from an outer surface of the curved upper plate 12, thereby increasing the resistance of the curved upper plate 12 to bending. The first ribs 14 extend substantially along the entire length of the curved upper plate 12 from one end to another. The curved upper plate 12 further includes several pairs of second ribs 16 which protrude upwardly and outwardly from an outer surface of the curved upper plate 12 and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at the depression 18. One end of the cylindrical post 22 is secured within the aperture 20, for example, by pressing. The other end of the cylindrical post 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an over-center manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from one another causes a central hinge portion 32 of the hinged leaves 26 to move toward the curved upper plate 12, thereby causing the ring members 28, which move with the hinged leaves 26, to move to an open position. Conversely, when the ring members 28 of the ring binder 10 are in an open position, movement of the actuating levers 30 toward one another causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

Referring now to FIGS. 5–10, an actuating lever 30 of the present invention is shown, which includes a main body 34 made of metal having a nickel plated finish. Each actuating lever 30 includes a plurality of reinforcing ribs 36 thereon to increase the rigidity of the main body 34. The main body 34 further includes a pair of grooves 38 on opposite side edges which form a pivot axis of the actuating lever 30. A lower portion of the main body 34 includes a hook member 40 which engages and moves the hinged leaves 26. An upper portion of the main body 34 is the portion engaged by the fingers of the user to pivot the actuating lever 30 about the pivot axis defined by the grooves 38, in order to open and close the ring members 28 of the ring binder 10.

Figure 5:
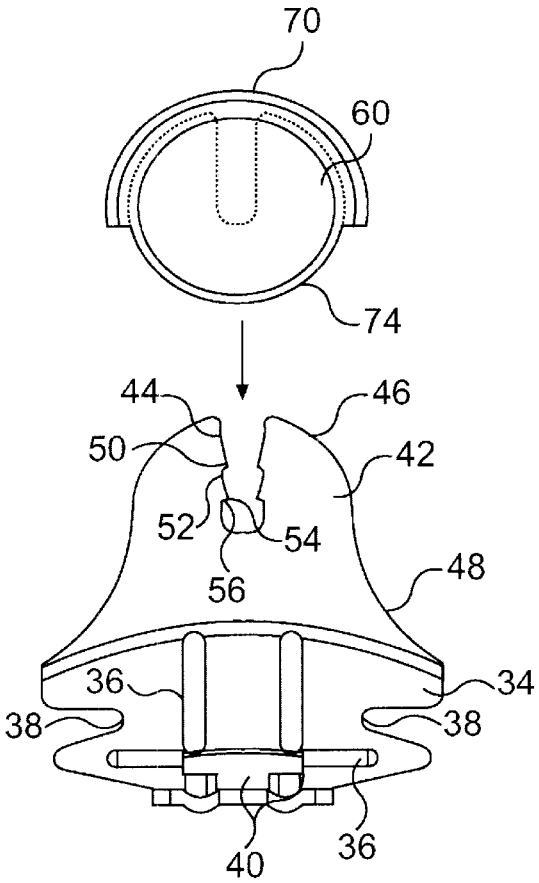
FIG. 5 is a front exploded view of the actuating lever of the present invention with the cushion member being assembled therewith.
Figure 6:
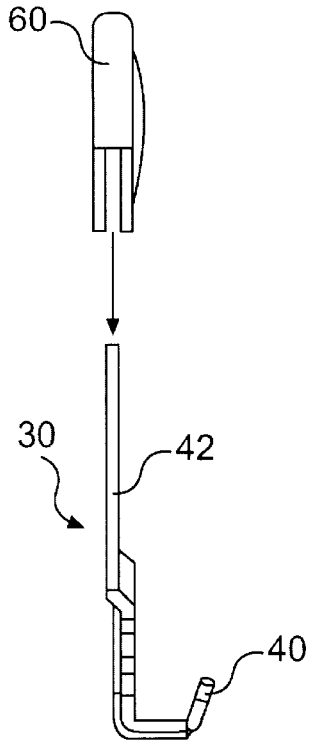
FIG. 6 is a side exploded view of the actuating lever of the present invention with the cushion member being assembled therewith.
Figure 7:
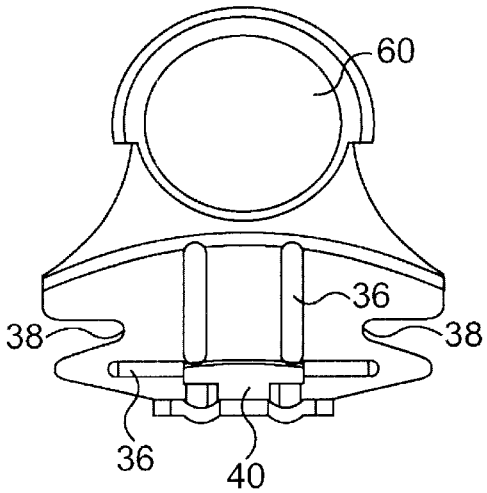
FIG. 7 is a view of the inner side of the actuating lever with the cushion member thereon.
Figure 8:
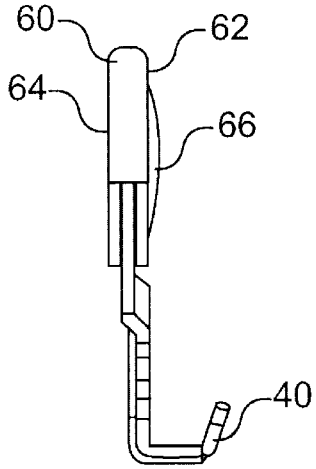
FIG. 8 is a side view of the actuating lever with the cushion member thereon.

The upper portion of the main body 34 includes a substantially flat tab 42 having an groove 44 therein. The tab 42 has a curved perimeter edge which includes a convexly-curved upper edge 46 and a pair of concavely-curved side edges 48. The curvature of the concavely-curved side edges 48 flows smoothly into the convexly-curved upper edge 46, as shown in FIG. 5.

The side edges of the groove 44 include a plurality of teeth 50. Each tooth 50 includes an inwardly-inclined forward portion 52 terminating at a point 54 within the groove 44, and a non-inclined rearward portion 56 extending outwardly from the point 54 to the side edge of the groove 44. Each side edge of the groove 44 preferably includes two teeth 50, although fewer or more teeth 50 may be used.

A cushion member 60 generally surrounds an upper portion of the tab 42 so that the user's fingers do not touch any rough edges which may exist on the tab 42, but instead touch the soft face of the cushion member 60. The cushion member 60 is a soft pad of resilient material, which is preferably formed of rubber, soft plastic, or a flexible elastomeric material.

The cushion member 60 has an inner face 62 and an outer face 64. The inner face 62 refers to the face closest to the rings 28 when the cushion member 60 is installed on the tab 42, and the outer face 64 refers to the face furthest from the rings 28 when the cushion member 60 is installed on the tab 42. The inner face 62 is engaged by the finger of a user to pivot the actuating lever 30 to move the ring members 28 to the open position, and the outer face 64 is engaged by the finger of a user to pivot the actuating lever 30 to move the ring members 28 to the closed position. A convex projection 66 is located on the inner face 62 of the cushion member 60.

Figure 11:
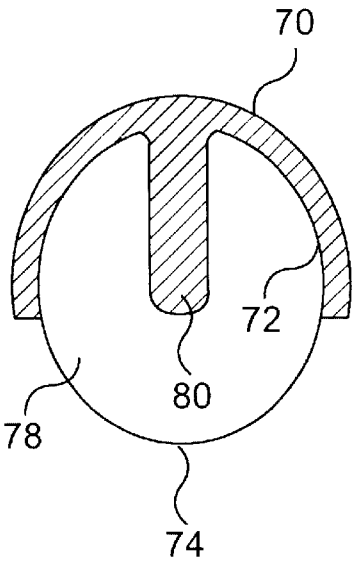
FIG. 11 is a cross-sectional view of the cushion member of the present invention.

As shown in FIGS. 5–11, the cushion member 60 has an upper wall including a convexly-curved outer wall 70 and a concavely-curved inner wall 72 which generally follows the contour of the convexly-curved upper edge 46 of the tab 42. The cushion member 60 further includes a convexly-curved lower wall 74 having an opening 76 therein which extends into a cavity 78 in the body of the cushion member 60. The concavely-curved inner wall 72, and inner surfaces of the inner face 62 and outer face 64 together define the boundaries of the cavity 78. The interior dimensions of the cavity 78 are approximately equal to or slightly smaller than the exterior dimensions of the tab 42 so that the cushion member 60 will fit snugly on the tab 42. As shown in FIGS. 5 and 11, the cushion member 60 includes a tongue 80 located approximately centrally therein which extends into the cavity 78.

Figure 10:
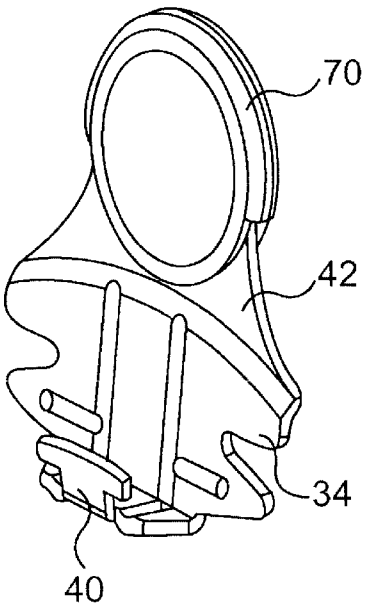
FIG. 10 is a perspective view of the inner side of the actuating lever with the cushion member assembled thereto.
Figure 9:
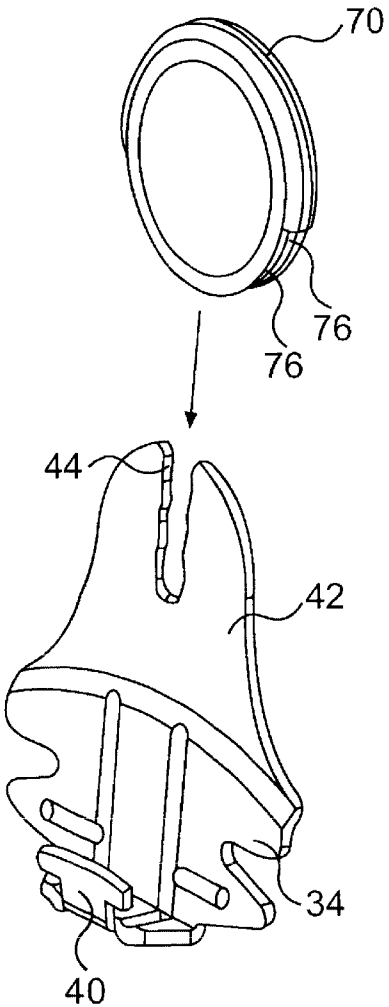
FIG. 9 is an exploded perspective view of an inner side of the actuating lever with the cushion member being assembled therewith.

As shown in FIGS. 9 and 10, to install the cushion member 60 onto the tab 42, the tab 42 passes freely through the opening 76 and slides into the cavity 78 of the cushion member 60. The cushion member 60 is pressed downwardly onto the tab 42 until the convexly-curved upper edge 46 of the tab 42 is seated against the concavely-curved inner wall 72 of the cavity 78.

The teeth 50 are configured so that the cushion member 60 may be easily placed on the tab 42. Once the cushion member 60 is placed on the tab 42, the points 54 of the teeth will embed into the walls of the tongue 80 to retain the cushion member 60 on the tab 42. The walls of the tongue 80 may be flat as shown in FIG. 11, or may include correspondingly shaped tooth-receiving indentations to assist in securing the cushion member 60 to the tab 42.

The cushion member 60 may also be retained on the tab 42 by the frictional engagement between the interior surfaces of the cavity 78 and the exterior surface of the tab 42.

To increase this frictional engagement, the interior surface of the cavity 78 is preferably a flat planar surface to maximize the surface contact between the cavity and the tab 42. Also, where the cushion member 60 is formed of a resilient material such as rubber or an elastomer, the frictional contact is enhanced to prevent slippage of the cushion member 60 off of the tab 42. If necessary, an adhesive can be used to assist in the securement of the cushion member 60 on the tab 42.

Although the cushion member 60 is preferably formed of rubber or soft plastic, it is conceived that other cushioning materials such as leather or dense foam may be utilized. Also, the cushion member 60 may be formed of different colors to coordinate the ring binder 10 with the cover member, or with the subject matter of the items contained within the loose-leaf binder.

Although the main body 34 of the actuating lever 30 is made of stamped metal having a nickel plated finish, it is possible to utilize other suitable strong and rigid materials, such as plastic, without departing from the invention.

It should be understood that while the preferred embodiment describes the ring binder 10 as being attached to the spine of the cover member, the ring binder may instead be attached to the front cover or the back cover. Also, although three ring members 28 are shown in FIGS. 1–4, it should be understood that any number and arrangement of ring members 28 may be utilized. For example, two or four ring members may be utilized. Also, the ring members 28 may be equally spaced-apart, or may have different spacings. Finally, although the ring members 28 shown are circular, it is envisioned that D-shaped or other ring shapes may be utilized.

Although the actuating lever cushion member 60 of the present invention has been described for use with a ring binder having a curved upper plate 12 with a pair of first reinforcing ribs 14 and several pairs of second ribs 16, it should be understood that the actuating lever cushion member 60 may be used with differently shaped upper plates which do not include reinforcing ribs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ring binder comprising:

an upper plate;

a pair of hinged leaves supported by said upper plate;

a plurality of rings attached to said hinged leaves and movable therewith;

at least one pivotable actuating lever for moving said hinged leaves from a first position where said rings are closed, to a second position where said rings are open, said actuating lever having a tab at an upper portion thereof including a groove therein; and a cushion member extending over and surrounding said tab and fixed to said actuating lever, said cushion member including a tongue received within and secured to said groove.

2. The ring binder according to claim 1, wherein said cushion member is formed of a resilient elastomeric material.

3. The ring binder according to claim 1, wherein said cushion member is formed as a one-piece unitary integral member.

4. The ring binder according to claim 1, wherein said cushion member has an inner face and an outer face, said inner face having a convex protrusion thereon.

5. The ring binder according to claim 1, wherein an interior surface of said cavity and an exterior surface of said tab are each substantially flat to increase surface contact between said cavity and said tab to promote frictional engagement between said interior surface of said cavity and said exterior surface of said tab.

6. The ring binder according to claim 1, wherein a side edge of said groove include at least one tooth.

7. The ring binder according to claim 6, wherein said tooth includes an inwardly-inclined forward portion terminating at a point, and a non-inclined rearward portion extending outwardly from said point.

8. The ring binder according to claim 1, wherein said tab has a perimeter edge which includes a convexly-curved upper edge and a pair of concavely-curved side edges.

9. The ring binder according to claim 8, wherein said cavity include a concavely-curved inner wall, said convexly-curved upper edge of said tab being seated against said concavely-curved inner wall of said cavity.

10. The ring binder according to claim 9, wherein a side edge of said groove include at least one tooth, said tooth including an inwardly-inclined forward portion terminating at a point, and a non-inclined rearward portion extending outwardly from said point.

11. In combination, a ring binder having a pivotable actuating lever with a tab at an upper portion thereof including a groove therein, and a cushion member extending over and surrounding said tab and fixed to said actuating lever, said cushion member including a tongue received within and secured to said groove.

12. The combination according to claim 11, wherein said cushion member is formed of a resilient elastomeric material.

13. The combination according to claim 11, wherein said cushion member is formed as a one-piece unitary integral member.

14. The combination according to claim 11, wherein said cushion member has an inner face and an outer face, said inner face having a convex protrusion thereon.

15. The combination according to claim 11, wherein an interior surface of said cavity and an exterior surface of said tab are each substantially flat to increase surface contact between said cavity and said tab to promote frictional engagement between said interior surface of said cavity and said exterior surface of said tab.

16. The combination according to claim 11, wherein a side edge of said groove include at least one tooth.

17. The combination according to claim 16, wherein said tooth includes an inwardly-inclined forward portion terminating at a point, and a non-inclined rearward portion extending outwardly from said point.

18. The combination according to claim 11, wherein said tab has a perimeter edge which includes a convexly-curved upper edge and a pair of concavely-curved side edges.

19. The combination according to claim 18, wherein said cavity include a concavely-curved inner wall, said convexly-curved upper edge of said tab being seated against said concavely-curved inner wall of said cavity.

20. The combination according to claim 19, wherein a side edge of said groove include at least one tooth, said tooth including an inwardly-inclined forward portion terminating at a point, and a non-inclined rearward portion extending outwardly from said point.

* * * * *